United States Patent [19]

Acosta

[11] 4,148,265

[45] Apr. 10, 1979

[54] SAFETY BOX

[76] Inventor: Evelio Acosta, 8315 W. 18 Lane Dr., Hialeah, Fla. 33010

[21] Appl. No.: 851,751

[22] Filed: Nov. 15, 1977

[51] Int. Cl.[2] ..... E05G 1/04

[52] U.S. Cl. ..... 109/59 R; 109/64; 292/213

[58] Field of Search ..... 109/58, 59, 64, 77; 70/168; 292/213, 214, 218, 259; 220/315

[56] References Cited

U.S. PATENT DOCUMENTS

| | | | |
|---|---|---|---|
| 1,103,401 | 7/1914 | Cox | 292/214 X |
| 1,567,881 | 12/1925 | Weber | 70/168 |
| 1,770,710 | 7/1930 | Prince | 70/168 |
| 2,800,090 | 7/1957 | Reid | 109/59 |
| 3,426,707 | 2/1969 | Heyl et al. | 109/59 |

FOREIGN PATENT DOCUMENTS

| | | | |
|---|---|---|---|
| 1043468 | 11/1953 | France | 292/218 |

*Primary Examiner*—Mervin Stein
*Assistant Examiner*—David H. Corbin
*Attorney, Agent, or Firm*—Haight, Hofeldt, Davis & Jambor

[57] ABSTRACT

A safety box, such as a safe or small vault adapted for mounting in the wall of a building, is provided with a removable cover or door. A rotary latching arrangement is key-actuated to cause the cover to be selectively secured to the box at a plurality of points to effectively seal an opening to the interior of the safety box. Opening of the safety box is achieved by utilizing the key to rotate the latching arrangement in order to release the cover for removal from the box.

10 Claims, 10 Drawing Figures

SAFETY BOX

BACKGROUND OF THE INVENTION

1. Field of the Invention

This invention relates generally to wall-mounted safety boxes, such as small safes or vaults, and more specifically, this invention relates to a cover and latching arrangement for a wall-mounted safety box.

2. Description of the Prior Art

In the past, safety boxes, such as small safes or vaults mounted in the walls of a building, have been constructed with a door hinged to the body of the safety box. A locking mechanism is generally located on the inner surface of the door, perhaps being located within a housing, and this locking mechanism, of course, protrudes into the hollow interior of the safety box when the door is closed. While this protrusion into the safety box in the closed position of the door is not ususally objectionable, when the door is opened it can be a nuisance. As the doors are frequently only permitted to open through approximately 90° of travel, which in itself restricts access to the interior of the safety box, the protruding locking mechanism further restricts accessibility to the interior of the safety box.

One solution to this problem has been to provide a completely removable door or cover. With this approach, a latching arrangement must be utilized that not only provides the selective sealing and unsealing of the previous locking mechanism, but must also provide the supporting and positioning function formerly provided by the permanent hinge mounting.

The conventional practice adopted to provide the desired latching arrangement has been to provide one or more dead bolts actuated in conjunction with the locking mechanism. However, the systems employed to manipulate the dead bolts are typically quite complex, involving the use of numerous cams, springs, gears and levers. Also, the tolerances in these systems are quite tight, and hence these systems are costly to produce, both in terms of the number of parts needed and the manufacturing processes involved. In addition, due to the complexity of these systems, malfunctions may occur which are irritating to the owner of the safety box and which may be costly to repair.

Thus, there is a need for a safety box which has a non-complex, reliable and easily manufactured cover or door. The latching arrangement of this cover should be easily actuatable to selectively support and lock the cover in the box, to prevent access to the interior of the box, and to disengage the cover from the box for removal, in order to permit access to the interior of the safety box.

SUMMARY OF THE INVENTION

The present invention provides a safety box having a non-complex latching arrangement to selectively secure a cover on the box to prevent access to the interior of the box, and to release the cover for removal to permit access to the interior of the box. This latching arrangement secures the cover to the safety box to provide the desired sealing, but it does not have the complex control mechanisms or other disadvantages of prior art approaches, and is much easier and less expensive to manufacture.

The safety box of the present invention includes a hollow body formed of a strong material, such as a suitable metal. An access opening permits access to the interior of the hollow body. In the case where the hollow body has a rectangular shape (the preferred embodiment disclosed herein), the opening would be located at one end of the hollow body.

A cover is utilized to close the access opening to prevent access to the interior of the hollow body. This cover has a cover plate formed of a strong material, such as a suitable metal, which fits into the access opening with a relatively tight fit.

A latch securing structure is located in the hollow body. In a preferred embodiment, this latch securing structure takes the form of a flange located about the inner periphery of the hollow body and extending toward the central axis of the hollow body, the latch securing flange being positioned inwardly from the opening. A plurality of engaging flanges may be secured to the latch securing flange (e.g., to each side of the rectangularly-shaped box of the preferred embodiment herein), the engaging flanges extending toward the opening to limit the amount by which the cover plate is inserted into the hollow body, thus positioning the cover and providing a sealing surface. These engaging flanges thus form a recessed opening smaller than the access opening.

A positioning and strengthening plate, smaller than the cover plate, is spaced from the cover plate and secured thereto. The positioning and strengthening plate is small enough to fit through the recessed opening, without contacting the engaging flanges or the latch securing flange.

Some suitable locking arrangement, such as a key-actuated cylinder lock, is mounted on and extends through the cover plate. A rotatable stem or shaft of the cylinder lock has a latching plate mounted thereon. This latching plate is located adjacent the positioning and strengthening plate, between the positioning and strengthening plate and the cover plate. The latching plate has a desired number of latching protrusions or arms located about the periphery thereof. These latching projections or arms are located substantially within the outline of the positioning and strengthening plate, when it is desired to remove or insert the cover, while actuation of the cylinder lock to rotate the latching plate will cause the arms to project to engage the latch securing flange and prevent removal of the cover.

While the latching plate may take any desired shape that will achieve these functions, it is desirable to have at least one latching arm engage the latch securing flange on each side of the box (in the rectangular embodiment disclosed herein). As a preferred embodiment disclosed herein, the latching plate takes the shape of two similar substantially right triangles facing in opposite directions, with the longer non-hypotenuse sides joined together for a portion of their length from the right angles of the triangles. With this arrangement, the ends of the hypotenuses of the triangles provide the latching arms to engage the latch securing flange. It should be noted that the positioning and strengthening plate is spaced far enough from the cover plate so that when the cover plate contacts the engaging flanges both the positioning and strengthening plate and the latching plate are positioned on the inside of the latch securing flange.

In this fashion, applicant has provided an easily manufactured safety box with a removable cover that obviates the difficulties of prior art safety boxes of this type. While applicant's safety box is preferably mounted in the wall of a building, and the box includes provisions for so mounting, the strong and secure, yet relatively simple, latching arrangement invented by applicant has applicability in other spheres.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
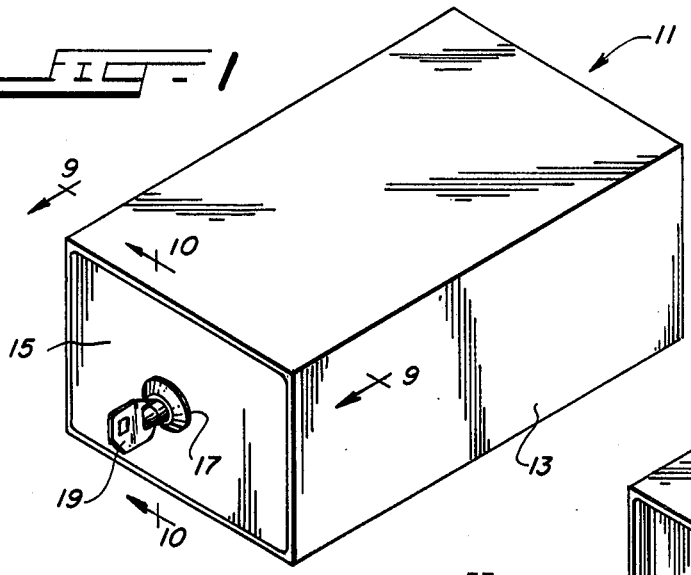
FIG. 1 is a perspective view of a safety box according to the present invention.

A safety box 11, such as a small wall-mounted safe or vault, is illustrated in the perspective view of FIG. 1. Safety box 11 includes a hollow body portion 13 and a cover or door 15. Cover 15 has an appropriate locking arrangement, such as a cylinder lock 17. This locking arrangement may be selectively activated, such as by a key 19.

Hollow body 13 of safety box 11 is made of suitably strong material, preferably a metal such as a heavy steel or iron. The reason for using a heavy strong material is, of course, to prevent anyone from breaking into the safety box and gaining unauthorized access to the contents. Also, it may be noted that the safety box of this preferred embodiment has a rectangular shape, although it should be recognized that other shapes, such as a cylindrical hollow body, could also be useful in some situations.

Figure 2:
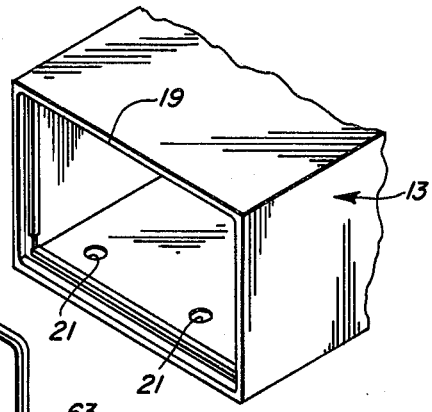
FIG. 2 is a partial perspective view of the safety box of FIG. 1 showing the cover plate removed from the body of the box.
Figure 2:
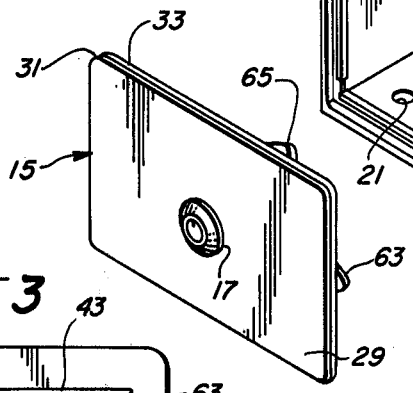
Figure 6:
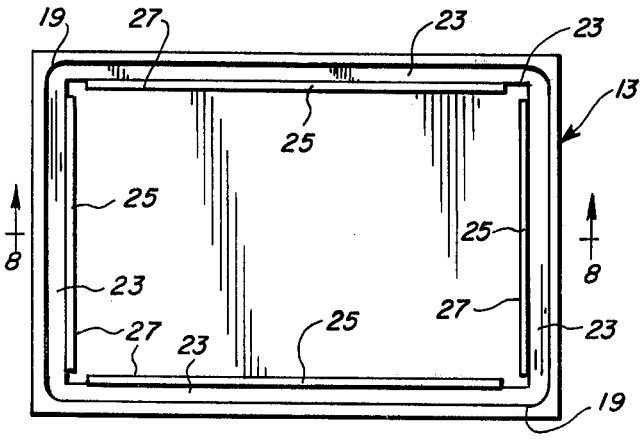
FIG. 6 is an enlarged front elevational view of the safety box of FIG. 1, with the cover plate removed.
Figure 4:
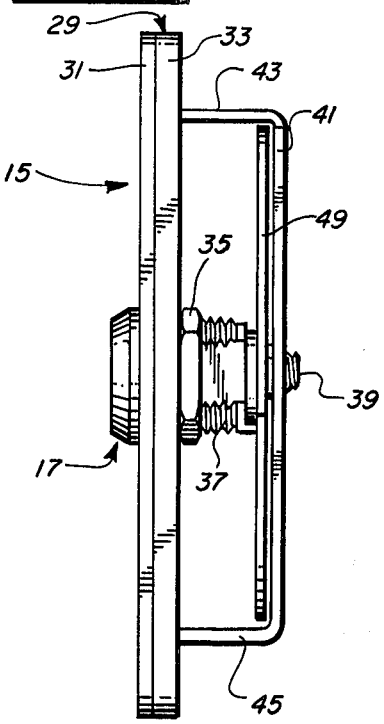
FIG. 4 is an enlarged side elevational view taken along line 4—4 of FIG. 3.

As best seen in FIGS. 2 and 6, hollow body 13 has a generally rectangular access opening 19 at one end to permit access to the interior of the hollow body. In its preferred utilization, hollow body 13 would be mounted in the wall of a building, with opening 19 facing toward the room where access to the box is to be achieved. Generally, hollow body 13 would be mounted so that the front portion defining opening 19 would be flush with, or slightly recessed from, the wall of the room. Suitable provisions for mounting body 13 in the wall would be provided, such as mounting holes 21 and other mounting holes (not shown) toward the other end of the body 13.

Spaced inwardly from access opening 19, there is a latch securing structure located about the inner periphery of hollow body 13, in order to provide for latching cover 15 to body 13 at a plurality of points. In this preferred embodiment, the latch securing structure takes the form of a continuous latch securing flange 23 rigidly secured to the hollow body and extending toward the central axis thereof. In the preferred embodiment of the present invention, the latch securing flange 23 may be integrally cast with the hollow body 13.

An engaging flange 25 extends outwardly toward opening 19 from each of the four sides of the latch securing flange 23. In this preferred embodiment, the engaging flanges 25 extend for substantially the entire length of the respective sides of the safety box 11, although there may be some circumstances in which this length would not be required. Also, in this preferred embodiment, the engaging flanges are integrally formed with the latch securing flange, although any rigid attachment would suffice. It may be noted that the engaging flanges 25 may be said to define a recessed opening 27, smaller than access opening 19.

Figure 3:
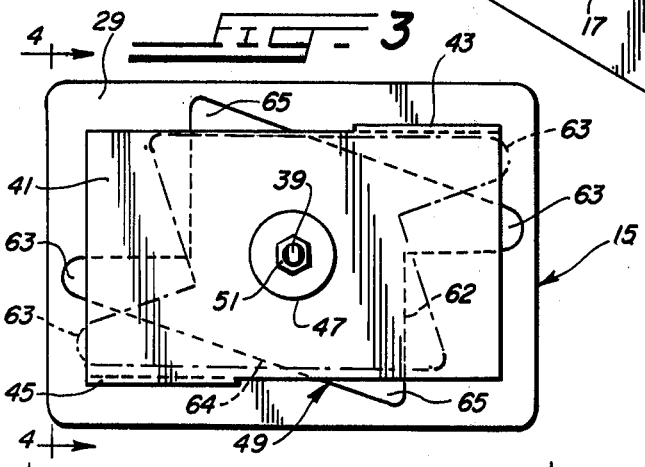
FIG. 3 is an enlarged elevational view of the back of the cover plate of the safety box of FIG. 1.

With reference now to FIGS. 2 and 3, cover 15 may be seen to have a cover plate 29. Cover plate 29 is made of a suitably strong material, preferrably a heavy metal such as steel. Cover plate 29 could be a single plate, but in the preferred embodiment disclosed herein, it is composed of two sandwiched plates 31 and 33.

Cylinder lock 17 is mounted in cover plate 29 by means of a nut 35 on threaded barrel 37. Barrel 37 extends through an appropriate opening formed in the cover plate 29. A rotatable central shaft or stem 39 extends outwardly from the barrel 37. As will be noted, the stem 39 is also threaded.

Figure 10:
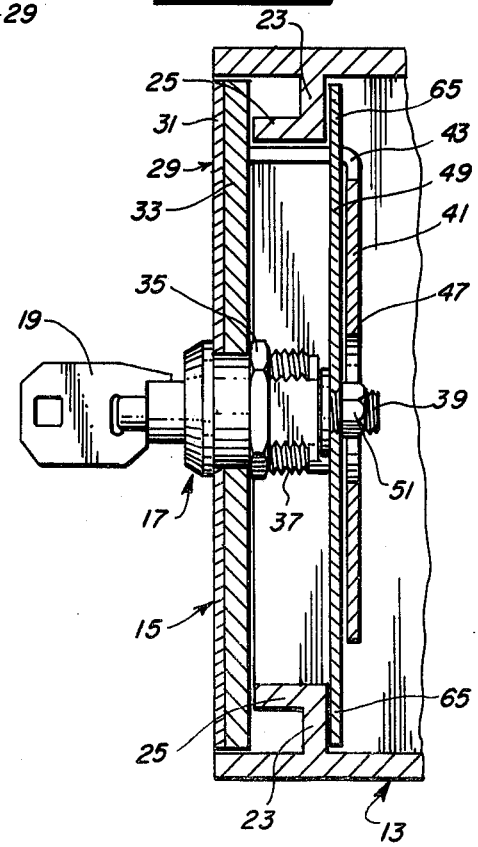
FIG. 10 is an enlarged partial cross-sectional view taken along line 10—10 of FIG. 1.

A positioning and strengthening plate 41 is spaced from and attached to cover plate 29 by supporting legs 43 and 45, located at diagonally opposed positions. Mounting legs 43 and 45 may be formed integrally with positioning and strengthening plate 41 and secured to cover plate 29 by any appropriate method, such as welding. The length of arms 43 and 45 is such as to place positioning and strengthening plate 41 a desired distance beyond latch securing flange 23 when cover plate 29 is brought into contact with engaging flanges 25, as best seen in FIG. 10. Positioning and strengthening plate 41 is smaller than cover plate 29, so that it can pass through the smaller recessed opening 27. A relatively large circular opening 47 is formed in the positioning plate 41 to permit the threaded stem 39 to extend therethrough with considerable clearance.

A latching plate 49 is attached to the threaded stem 39 by a nut 51 (and the opening 47 is sufficiently large to provide a large clearance about this nut also). The location of the latching plate 49 on stem 39 is such that it is adjacent to the positioning and strengthening plate 41, between the positioning and strengthening plate 41 and the cover plate 29. When cover plate 29 is brought into contact with engaging flanges 25, the latching plate 49 should be immediately beyond the latch securing flange 23, again best seen in FIG. 10. Positioning and strengthening plate 41 assures that latching plate 49 is not skewed but is maintained in the proper vertical plane. Also, plate 41 prevents an outward force on cover 15 from pulling latching plate 49 off stem 39 or distorting plate 49 to permit removal of the cover, thus strengthening the latching arrangement.

Insertion of a proper key 19 into the cylinder lock 17 permits the person holding the key to impart a limited amount of rotation to stem 39, while barrel 37 remains stationary. Accordingly, it is desired to form latching plate 49 such that the relatively limited rotation that may be imparted to stem 39 can be utilized to move the latching plate from a latched to a non-latched position, and vice versa. In addition, the latching plate 49 should contact the latch securing flange 23 at a plurality of points, preferably at least one point on each side of the box.

Figure 7:
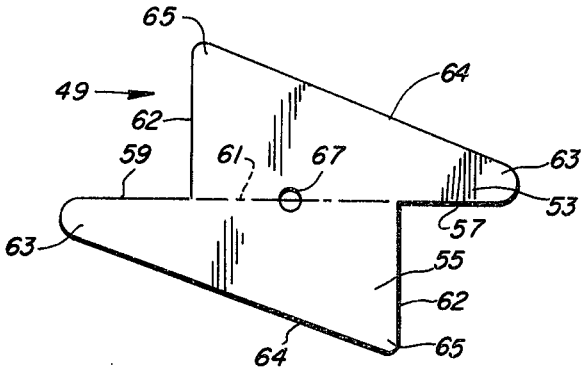
FIG. 7 is an enlarged plan view of the latching plate on the door of the safety box of FIG. 1.
Figure 5:
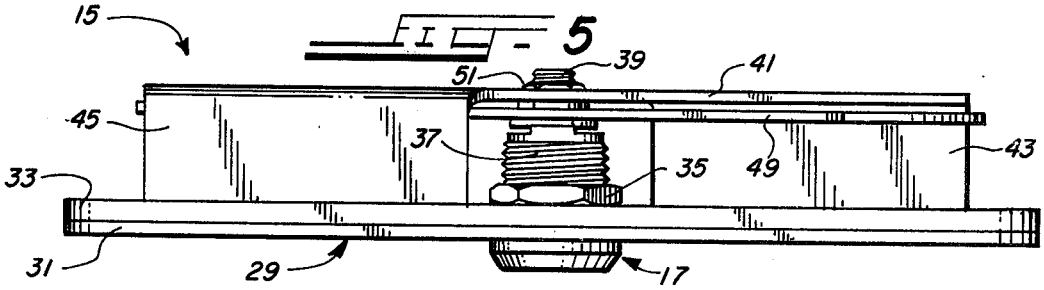
FIG. 5 is an enlarged bottom plan view of the cover plate taken along line 5—5 of FIG. 3.
Figure 8:
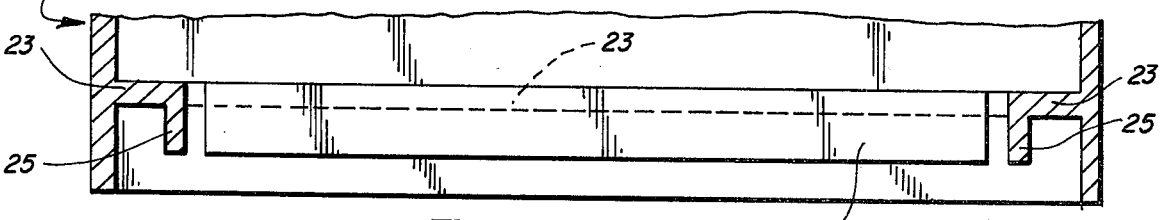
FIG. 8 is an enlarged partial cross-sectional view taken along line 8—8 of FIG. 6.

While any geometrical shape may be utilized that would provide latching arms that may be rotated to a retracted position, in which the cover may be inserted into and removed from opening 19, or to an extended or projecting position where the latching arms engage the latch securing flange 23 to prevent removal of the cover, a particular shape of the latching plate utilized in this preferred embodiment is illustrated in FIG. 7. The preferred form of latching plate 49 illustrated in FIG. 7 may be described as being two similar substantially right triangles 53 and 55 facing in opposite directions with a portion of their longer non-hypotenuse sides 57 and 59, respectively, being joined together (sides 57 and 59 are shown as extended by dotted line 61, which is included solely for purposes of defining the triangles 53 and 55). The portions of the sides 57 and 59 that are joined extend outwardly from the right angles.

With this arrangement, the ends of hypotenuses 62 and 64 adjacent the longer non-hypotenuse sides 57 and 59 form latching arms 63. Similarly, the ends of hypotenuses 62 and 64 adjacent the shorter non-hypotenuse sides form latching arms 65. It may be noted that while both latching arms 63 and 65 are somewhat rounded, latching arms 63 are formed with considerably more curvature than latching arms 65. A hole 67 is formed in the middle of latching plate 49 to permit the mounting on stem 39.

Figure 9:
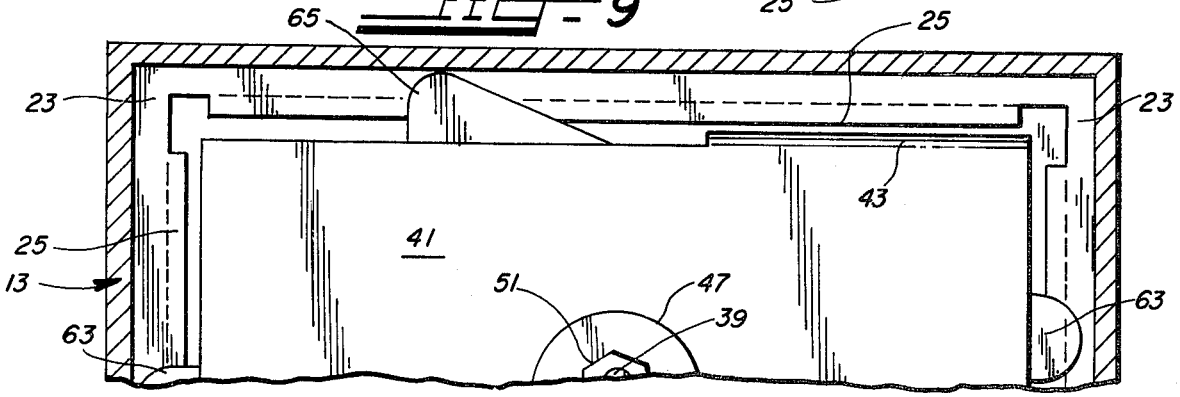
FIG. 9 is an enlarged partial cross-sectional view taken along line 9—9 of FIG. 1.

In FIG. 3, latching arms 63 and 65 (solid lines) are shown extending beyond positioning and strengthening plate 41 in the latching or locking position. With latching plate 49 in this position, latching arms 65 engage latch securing flange 23 at the top and bottom of safety box 11 (as illustrated in FIG. 10), and latching arms 63 engage latch securing flange 23 on the sides of the box (as seen in FIG. 9). When it is desired to insert cover 15 into the body 13 of the safety box 11, or remove it therefrom, latching plate 49 is rotated to the position shown in dotted lines in FIG. 3. In this position, it may be seen that latching plate 49 is substantially within the outlines of positioning and strengthening plate 41, with only the ends of latching arms 63 extending beyond the outline of positioning and strengthening plate 41. With latching plate 49 in this position, the latching arms are retracted so as to not contact latch securing flange 23, and the cover 15 may be inserted or removed from body 13.

Illustrative of the ease of assemblying this safety box is the brief description that is required of the assembly process. Hollow body 13 may be integrally cast with latch securing flange 23 and engaging flanges 25, the flanges having the desired positions and shapes. Cover 15 may be assembled by inserting cylinder lock 17 into an appropriate opening in cover plate 29 and securing lock 17 to plate 29 by nut 35. Latching plate 49 may then be located on stem 39 and secured in place by means of nut 51 (and a lock washer, if so desired). Positioning and strengthening plate 41 is then welded to the back of cover plate 29 to complete the entire assembly of the safety box 11.

It should be understood that various modifications, changes and variations may be made in the arrangement, operation and details of construction of the elements disclosed herein without departing from the spirit and scope of this invention.

I claim:

1. A safety box comprising:

a hollow body formed of a strong material;

an opening permitting access to the interior of said body;

latch securing means located at a plurality of points about the inner periphery of said body, said points being positioned inwardly from said opening;

a cover formed of a strong material to selectively close said opening;

a key-activated stem rotatably mounted in said cover plate;

a generally flat latching plate solid but for a generally centrally located mounting hole for mounting said latching plate on said key-activated stem, said latching plate being formed in the shape of two similar substantially right triangles facing in opposite directions with the longer non-hypotenuse sides joined together for a portion of their length extending from the right angles of the triangles, the ends of the hypotenuses of the triangles providing a plurality of latching arms, corresponding in number to the plurality of points of said latch securing means, positioned about said latching plate so that rotation of said latching plate to a given position causes said latching arms to engage said latch securing means, said latching arms having a retracted position to permit removal of said cover from said body; and locking means for rotating said latching plate to cause said latching arms to be moved from said retracted position to engage said latch securing means when said cover is to be fastened on said body in order to prevent access to the interior of said body.

2. A safety box as claimed in claim 1 wherein said cover comprises:

a cover plate formed of a strong material and shaped to pass through said opening with a relatively tight fit; and a positioning and strengthening plate secured to said cover plate and spaced therefrom, said latching plate mounted adjacent said positioning and strengthening plate, between said positioning and strengthening plate and said cover plate.

3. A safety box as claimed in claim 1 wherein said latch securing means comprises a flange positioned inwardly from said opening and extending toward the central axis of said body from the inner periphery thereof.

4. A safety box as claimed in claim 3 and further comprising a plurality of engaging flanges located about the periphery of said body, said engaging flanges being secured to said latch securing flange and extending toward said opening.

5. A safety box as claimed in claim 1 wherein:

said key-activated stem is threaded and is a part of a cylinder lock;

a threaded barrel of said cylinder lock, having a diameter greater than the diameter of said stem, extends through an appropriate opening in said cover;

a nut is threaded on said barrel to securely mount said cylinder lock on said cover; and a nut is threaded on said key-activated stem to secure said latching plate to said stem.

6. A safety box comprising:

a generally rectangular hollow body formed of a strong material;

an access opening formed in one end of said body to permit access to the interior of said body;

a latch securing flange positioned inwardly from said opening and extending toward the central axis of said body from the inner periphery thereof;

an engaging flange on each side of said body, said engaging flanges rigidly attached to said latch securing flange and extending toward said opening to define a smaller recessed opening;

a cover plate formed of a strong material and shaped to pass through said access opening with a relatively tight fit, said cover plate contacting said engaging flanges to close said recessed opening and said access opening;

a smaller positioning and strengthening plate to pass through said recessed opening, said positioning and strengthening plate being secured to said cover plate and space therefrom;

a generally flat latching plate solid but for a generally centrally located mounting hole and formed in the shape of two similar substantially right triangles facing in opposite directions with the longer non-hypotenuse sides joined together for a portion of their length extending from the right angles of the triangles, the ends of the hypotenuses of the triangles providing latching arms having a retracted position substantially within the outlines of said positioning and strengthening plate for removal of said cover plate from said body;

a key-activated stem rotatably mounted in said cover plate, said stem extending through said mounting hole in said latching plate for said latching plate to be mounted on said stem adjacent said positioning and strengthening plate, between said positioning and strengthening plate and said cover plate, whereby rotation of said stem with said cover plate in contact with said engaging flanges rotates said latching plate to cause said latching arms to engage said latch securing flange to prevent access to the interior of said body.

7. A safety box as claimed in claim 6 wherein the ends of the hypotenuses adjacent the longer non-hypotenuse sides of the triangles of said latching plate are substantially rounded.

8. A safety box as claimed in claim 6 wherein:

said key-activated stem is threaded and is a part of a cylinder lock;

a threaded barrel of said cylinder lock, having a diameter greater than the diameter of said stem, extends through an appropriate opening in said cover;

a nut is threaded on said barrel to securely mount said cylinder lock on said cover; and a nut is threaded on said key-activated stem to secure said latching plate to said stem.

9. A cover for a safety box comprising:

a substantially rectangular cover plate formed of a strong material;

a smaller positioning and strengthening plate secured to said cover plate and spaced therefrom;

a generally flat latching plate solid but for a generally centrally located mounting hole and formed in the shape of two similar substantially right triangles facing in opposite directions with the longer non-hypotenuse sides joined together for a portion of their length extending from the right angles of the triangles, the ends of the hypotenuses of the triangles providing latching arms; and a key-activated stem rotatably mounted in said cover plate and extending through said mounting hole in said latching plate, said latching plate being mounted on said stem adjacent said positioning and strengthening plate, between said positioning and strengthening plate and said cover plate, rotation of said stem causing said latching arms to be selectively positioned substantially within the outline of said positioning and strengthening plate or extending therefrom.

10. A safety box as claimed in claim 9 wherein:

said key-activated stem is threaded and is a part of a cylinder lock;

a threaded barrel of said cylinder lock, having a diameter greater than the diameter of said stem, extends through an appropriate opening in said cover;

a nut is threaded on said barrel to securely mount said cylinder lock on said cover; and a nut is threaded on said key-activated stem to secure said latching plate to said stem.

* * * * *